United States Patent [19]

Granone

[11] 4,087,912

[45] May 9, 1978

[54] PUNCH

[76] Inventor: Charles J. Granone, 452 Gavilan Pl., NW., Albuquerque, N. Mex. 87107

[21] Appl. No.: 651,000

[22] Filed: Jan. 21, 1976

[51] Int. Cl.[2] ..... B26F 1/00

[52] U.S. Cl. ..... 30/366

[58] Field of Search ..... 30/367, 366; 83/687, 83/686, 688

[56] References Cited

U.S. PATENT DOCUMENTS

| | | | |
|---|---|---|---|
| 295,227 | 3/1884 | Briggs et al. | 83/688 |
| 770,238 | 9/1904 | Lovejoy | 83/686 |
| 1,092,274 | 4/1914 | Lindstedt et al. | 30/367 X |
| 2,161,969 | 6/1939 | Mange | 30/366 X |
| 2,675,079 | 4/1954 | Hughes | 30/367 |
| 3,010,207 | 11/1961 | Barnes | 30/366 |

FOREIGN PATENT DOCUMENTS

| | | | |
|---|---|---|---|
| 478,772 | 7/1929 | Germany | 83/687 |
| 145,706 | 4/1921 | United Kingdom | 30/367 |

*Primary Examiner*—James L. Jones, Jr.
*Assistant Examiner*—J. T. Zatarga
*Attorney, Agent, or Firm*—John J. Byrne; Edward E. Dyson

[57] ABSTRACT

An elongated steel punch having a body section wherein one end is pointed and between the point and the body, a series of step portions are provided whereby a single tool can be used to pierce a work material in a manner to form holes of different diameters depending solely on the depth of penetration of the tool.

4 Claims, 2 Drawing Figures

PUNCH

This invention relates to a metal punch formed with a series of steps along its piercing end wherein each step has a diameter corresponding to the diameter of standard metal screws normally used in the sheet metal fastening field. The punch is so constructed to produce holes of various diameter by successive penetration of the metal sheet.

Prior to the invention described herein, it was necessary for mechanics in the trade to carry a series of punch tools with them and to perform the time-consuming task of selecting the correct punch for the fasteners being used.

Several workers in the prior art have addressed themselves to solving the problem of causing mechanics to carry a great many tools with them to the site where the work is to be performed. Oftentimes the mechanics are performing their work in dangerous and/or remote areas. Many roofing and siding materials are secured to the underlying structure causing the mechanic to first form a hole in the material. One inventor, Mr. Jonothan Sudweeks, U.S. Pat. No. 1,541,078, partially solved this problem by inventing a compound tool wherein a plurality of punching elements of different size are nested with relation to one another. This solved the problem to some extent but still required a plurality of punches. The Sudweeks system still required the mechanic to carry a plurality of tools.

Another inventor, M. E. Barnes, U.S. Pat. No. 3,010,207 has disclosed a punch having relative dimensioning of certain portions along its piercing end but did not recognize the value of the essential feature of the instant invention; namely, a series of cylindrical punching portions of sequentially larger shank diameters formed in a working portion of unitary constrution. Of course, Barnes was addressing himself to a mis-alignment of holes in sandwich-type constructions and, therefore, was not addressing himself precisely to the problem solved by the invention described herein.

It is accordingly a principal object of this invention to eliminate the requirement of a multiple of punches that must be carried by a mechanic to his job site.

It is another objective of this invention to facilitate the worker's job by providing a tool that has a comfortable body length and size and wherein the intermediate shank portions are of sufficient length to readily determine the depth of penetration.

Another important objective of this invention is to provide the steps in the intermediate portions to be frustoconical so as to help in the penetration but provide a sufficient barrier to excessive penetration. In other words, the user will "feel" as each step is passed.

These and other objects of the invention will become more apparent to those skilled in the art by reference to the following detailed description when viewed in light of the accompanying drawings wherein.

Figure 1:
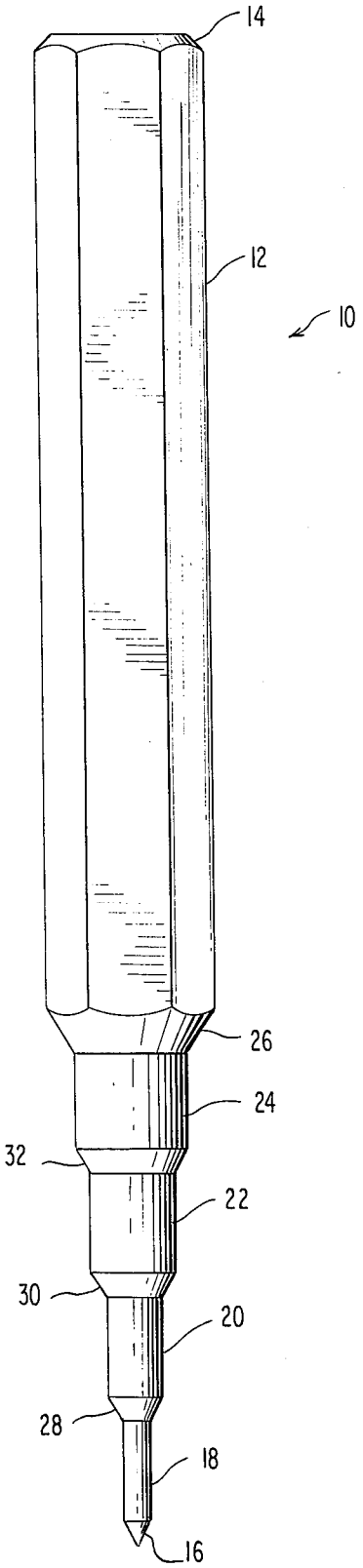
FIG. 1 is a side elevation view of the tool.
Figure 2:
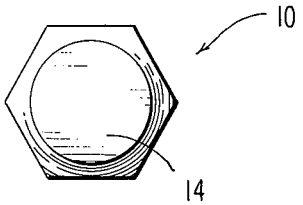
FIG. 2 is a top plan thereof.

Referring now more particularly to the drawings wherein like numerals indicate like parts, the numeral 10 generally indicates the punch tool 12 of this invention. The tool has a main handle 12 having a polygonal cross-section, in the disclosure shown a hexagon, for easy handling by workmen.

The tool further includes a striking stem 14 and a conical pointed end 16. Intermediate the conical pointed end 16 and the handle 12 are a series of intermediate punching portions 18, 20, 22 and 24 formed in a working portion of unitary construction. At the upper end of portion 24 a frustoconical surface 26 blends into handle 12.

Between the protions 18 and 20 is a frustoconical step surface 28 between portions 20 and 22, a similar surface 30; and between portions 22 and 24, a similar surface 32.

The diameters and circumferences of the intermediate portions 18, 20, 22 and 24 are sequentially greater as they recede from point 16 and approach the handle portion 12. The longitudinal lengths of each of the intermediate portions is approximately the same and substantially less than the length of the handle portion.

Each of the longitudinal lengths of the intermediate portions is sufficiently long so that a mechanic tapping the tool at end 14 can readily determine when the work material has been pierced. Indicia can be provided on each of the intermediate portions so that the workmen can readily determine the number of steps that must penetrate the material to correspond with the fastener bolt or screw that he is utilizing.

A punch has been described which will have appreciable benefits to its user. Like most tools, its usefulness and desirability increases as the skill of the user increases.

In a general manner, while there has been disclosed an effective and efficient embodiment of the invention, it should be well understood that the invention is not limited to such an embodiment as there might be changes made in the arrangement, disposition, and form of the parts without departing from the principle of the present invention as comprehended within the scope of the accompanying claims.

I claim:

1. An elongated punch consisting essentially of:

(a) a handle having a striking surface at one end and (b) a stepped working portion of unitary construction carried by said handle at the end opposite to said striking surface, said stepped working portion having (i) a conical pointed end remote from said handle, (ii) a plurality of integral cylindrical punching portions of sequentially greater cross-section in the direction of said handle, the cylindrical punching portion having the smallest cross-section being located immediately adjacent said pointed end and being of a diameter equal to the diameter of the base of said conical pointed end, and (iii) a plurality of frustoconical portions each of which has a length substantially less than the length of said cylindrical punching portions, one of said frustoconical portions being located between and connecting each pair of adjacent cylindrical punching portions, whereby said elongated punch can be used to pierce a work material in a manner to form holes of different diameter depending solely on the depth of penetration of said stepped working portion through the work material.

2. The punch of claim 1 wherein the lengths of said cylindrical punching portions are approximately the same.

3. The punch of claim 1 wherein the cross-sectional shape of said handle is a polygon having from three to eight sides.

4. The punch of claim 3 wherein a tapered, conical section connects said handle to the one of said intermediate cylindrical punching portions adjacent said handle.

* * * * *